US006983942B2

(12) United States Patent
Chen

(10) Patent No.: US 6,983,942 B2
(45) Date of Patent: Jan. 10, 2006

(54) ADJUSTABLE SKATE

(75) Inventor: Henry T. Chen, Taipei (TW)

(73) Assignee: Minson Enterprises Co., Ltd., Taipei (TW)

( * ) Notice: Subject to any disclaimer, the term of this patent is extended or adjusted under 35 U.S.C. 154(b) by 26 days.

(21) Appl. No.: 10/325,666

(22) Filed: Dec. 19, 2002

(65) Prior Publication Data

US 2003/0111808 A1 Jun. 19, 2003

Related U.S. Application Data

(63) Continuation-in-part of application No. 10/004,163, filed on Oct. 30, 2001, now Pat. No. 6,669,210, which is a continuation-in-part of application No. 09/833,758, filed on Apr. 12, 2001, now abandoned, which is a continuation-in-part of application No. 09/141,170, filed on Aug. 27, 1998, now Pat. No. 6,217,039.

(60) Provisional application No. 60/073,464, filed on Feb. 2, 1998.

(51) Int. Cl.
*A63C 17/26* (2006.01)

(52) U.S. Cl. ..... 280/11.26; 280/11.12

(58) Field of Classification Search ..... 280/11.19, 280/11.26, 11.27, 11.231, 11.12; 36/97
See application file for complete search history.

(56) References Cited

U.S. PATENT DOCUMENTS

| | | | | |
|---|---|---|---|---|
| 2,009,684 A | | 7/1935 | Affronte | 36/2.5 |
| 2,245,769 A | * | 6/1941 | Flamm | 280/11.19 |
| 2,497,175 A | | 2/1950 | Mantos | 36/2.5 |
| 2,523,449 A | | 9/1950 | Rosenweig | 36/2.5 |
| 2,572,050 A | | 10/1951 | Ornstein | 280/11.3 |
| 2,734,284 A | | 2/1956 | Seurbom | 36/2.5 |
| 3,309,098 A | * | 3/1967 | Parker | 280/11.26 |
| 3,389,481 A | | 6/1968 | England | 36/2.5 |
| 3,993,318 A | * | 11/1976 | Rothmayer | 280/11.26 |
| 4,304,417 A | | 12/1981 | Hsieh | 280/11.26 |
| 4,328,627 A | | 5/1982 | Sanders | 36/115 |
| 4,418,929 A | | 12/1983 | Gray | 280/11.23 |
| 4,468,045 A | | 8/1984 | Sarazen | 280/11.3 |
| 4,684,140 A | * | 8/1987 | Olivieri | 280/11.26 |
| 4,807,893 A | | 2/1989 | Huang | 280/11.2 |
| 4,998,358 A | | 3/1991 | Girardelli | 36/117 |
| D323,055 S | | 1/1992 | Cavasin | D2/275 |
| D323,056 S | | 1/1992 | Cavasin | D2/275 |
| D324,937 S | | 3/1992 | Cavasin | D2/276 |
| 5,172,924 A | | 12/1992 | Barci | 280/14.2 |
| 5,184,834 A | | 2/1993 | Yu | 280/7.13 |
| 5,400,484 A | | 3/1995 | Gay | 24/585 |
| 5,416,988 A | | 5/1995 | Potter et al. | 36/89 |

(Continued)

FOREIGN PATENT DOCUMENTS

FR 2584936 * 1/1987

(Continued)

*Primary Examiner*—Frank Vanaman
(74) *Attorney, Agent, or Firm*—Westman, Champlin & Kelly, P.A.

(57) ABSTRACT

A skate comprises a chassis with a variable length boot disposed thereon. The variable length boot includes a heel portion fixedly disposed upon the chassis and a toe box slidably disposed upon the chassis. The toe box is slidable in relation to the heel along the longitudinal axis of the skate to increase or decrease the size of the boot. A locking mechanism attached to the toe box locks the toe box to the chassis at a selected position. The selected position is chosen from a plurality of spaced-apart slots disposed within the chassis. The locking mechanism includes a positionable clasp insertable into a selected slot to lock the toe box to the chassis at the selected position.

24 Claims, 5 Drawing Sheets

U.S. PATENT DOCUMENTS 5,484,149 A * 1/1996 Lee ..... 280/11.26
5,615,901 A 4/1997 Piotrowski ..... 280/7.14
5,645,288 A 7/1997 Lu ..... 280/11.26
5,678,833 A 10/1997 Olson et al. ..... 280/11.22
5,735,536 A 4/1998 Myers et al. ..... 280/7.13
5,762,346 A 6/1998 Conte ..... 280/11.22
5,765,870 A 6/1998 Riley ..... 280/825
5,775,705 A 7/1998 Cochimin ..... 280/7.1
5,794,362 A 8/1998 Polk, III et al. ..... 36/97
5,803,467 A 9/1998 Piotrowski ..... 280/7.14
5,836,592 A * 11/1998 Chang ..... 280/11.26
5,842,293 A 12/1998 Young ..... 36/97
5,899,006 A 5/1999 Donnadieu ..... 36/97
5,913,526 A 6/1999 Olson et al. ..... 280/11.22
5,924,218 A 7/1999 Dalvy et al. ..... 36/55
5,931,478 A * 8/1999 Chang ..... 280/11.231
5,934,693 A 8/1999 Nicoletti ..... 280/11.22
5,951,028 A 9/1999 Lovitt et al. ..... 280/11.22
5,971,406 A 10/1999 Lyman ..... 280/11.22
5,992,861 A 11/1999 Piotrowski ..... 280/7.14
5,993,585 A 11/1999 Goodwin et al. ..... 156/145
6,045,144 A 4/2000 Wong ..... 280/11.26
6,050,004 A 4/2000 Miralles et al. ..... 36/97
6,050,574 A 4/2000 Olson et al. ..... 280/11.22
6,070,885 A 6/2000 Ferone ..... 280/11.19
6,073,941 A 6/2000 Hilgarth ..... 280/11.22
6,082,027 A 7/2000 Wagonhurst ..... 36/97
6,113,111 A 9/2000 Gierveld et al. ..... 280/11.15
6,173,975 B1 1/2001 Brandner ..... 280/11.22
6,193,277 B1 2/2001 Marasco et al. ..... 280/825
6,212,796 B1 4/2001 Kubelka ..... 36/50.1
6,213,479 B1 4/2001 Cochimin ..... 280/7.1
6,216,366 B1 4/2001 Donnadieu ..... 36/97
6,217,039 B1 4/2001 Iverson et al. ..... 280/11.26
6,241,264 B1 6/2001 Page ..... 280/11.19
6,247,707 B1 6/2001 Conte ..... 280/11.221
6,273,437 B1 8/2001 Lovitt et al. ..... 280/11.233
6,276,697 B1 8/2001 Lin ..... 280/11.26
6,308,965 B1 10/2001 Yang ..... 280/11.221
6,374,516 B1 4/2002 Bonaventure et al. ..... 36/115
6,402,163 B1 6/2002 Pratt ..... 280/11.26
6,422,578 B1 7/2002 Oh ..... 280/11.232
6,422,579 B1 7/2002 Lindblad ..... 280/11.26
6,425,587 B1 7/2002 Moon ..... 280/11.206
6,431,604 B1 8/2002 Goeckel ..... 280/811
2001/0006281 A1 * 7/2001 Gorza et al. ..... 280/11.223

FOREIGN PATENT DOCUMENTS

FR 2 668 072 10/1990

* cited by examiner

ADJUSTABLE SKATE

CROSS-REFERENCE TO RELATED APPLICATION(S)

This application is a continuation-in-part of application Ser. No. 10/004,163; filed Oct. 30, 2001 now U.S. Pat. No. 6,669,210, which is a continuation-in-part of application Ser. No. 09/833,758; filed Apr. 12, 2001 abandoned, which is a continuation of application Ser. No. 09/141,170; filed Aug. 27, 1998; U.S. Pat. No. 6,217,039, which claims priority of U.S. Provisional Application No. 60/073,464; filed Feb. 2, 1998, entitled "ADJUSTABLE SKATE".

BACKGROUND OF THE INVENTION

The present invention relates to skates, and in particular to skates wherein the boot size is adjustable to accommodate different foot sizes.

Both ice skating and in-line skating have been a popular recreational activities for many years, especially for children. However, children have growing feet, and to enjoy skating the skates should properly fit the child's feet. Of course with growing feet, a new pair of skates must be purchased as the child's feet grow, sometimes on an annual basis. Additionally, many elementary schools have begun incorporating in-line skating into daily physical exercise activities. In order to accommodate the various foot sizes of many children, many different sized skates must be purchased. Assigning a child the correct skate size is time intensive, as is the process of collecting and distributing the skate during the exercise periods.

There exists in the prior art boots that are modifiable in length. However, there does not exist in the prior art skates that can be modified in length, and yet be durable, and also have a minimum number of parts to keep down costs and be easy for children to use. Thus, there is a need to provide a skate that can be modified in length, durable to the rigors that children put skates through and also be simple for children to use. The skate of the present invention, being modifiable in length and width, durable and simple to use is advantageous especially for use by youth whose foot size may change significantly in a short period of time. Additionally, the skate of the present invention is advantageous for schools where a number of children, having many different foot sizes, need proper fitting skates and a relatively short amount of time to collect or distribute the skates.

BRIEF SUMMARY OF THE INVENTION

The present invention comprises a skate that has a variable length boot disposed upon a frame. The boot can be modifiable in length and includes a heel portion and a toe box. The heel portion is disposed upon a rear section of the frame. The toe box is slidably disposed upon a forward section of the frame and is slidable in relation to the heel portion. The forward section of the frame includes a plurality of spaced-apart slots for receiving a clasp of a locking mechanism. The locking mechanism locks the toe box to the forward section of the frame at a selected position, defining the length of the boot. The locking mechanism includes a lever connected to the clasp to urge the clasp into engagement with a selected slot.

DETAILED DESCRIPTION

Figure 1:
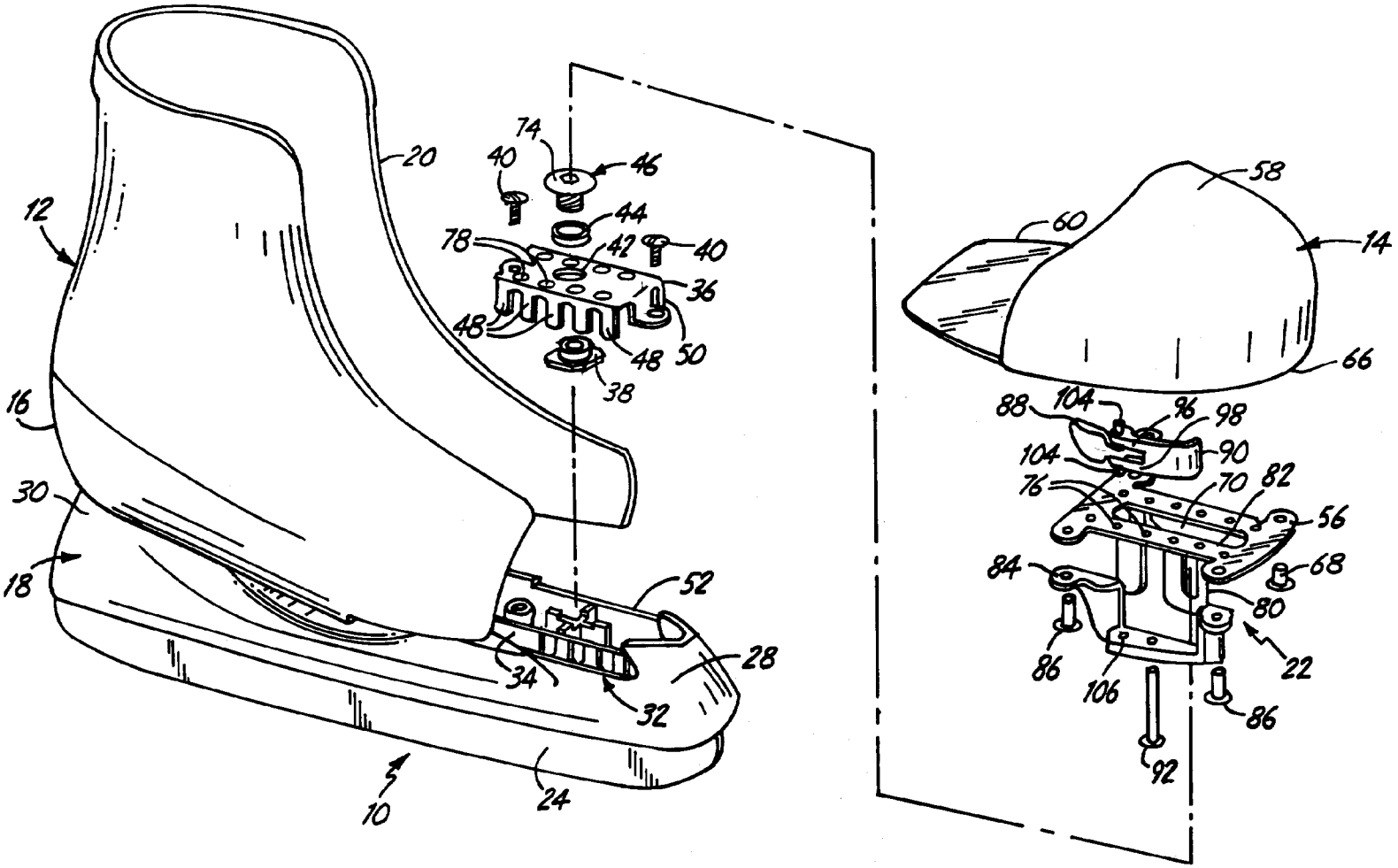
FIG. 1 is an exploded perspective view of a first embodiment of an adjustable skate of the present.

The skate of the present invention is generally illustrated at 10 in FIG. 1. The skate 10 includes a boot 12 whose size may be modified in length. The boot 12 includes a toe box 14 and a heel portion 16 disposed upon a chassis 18. The boot 12 further includes a cuff portion 20 integrally formed with the heel portion 16. A conventional buckle or a suitable fastener (not shown) is secured to the cuff 20 so that the cuff 20 may be securely fastened to the leg of a wearer. The toe box 14 is slidably attached to the chassis 18 and is positionable along a longitudinal axis of the skate 10 to increase or decrease the length of the boot. Upon selectively positioning the toe box 14 to achieve the desired length of the boot 12, the toe box 14 is locked at the selected position to the chassis 18 by a locking mechanism 22.

Figure 3:
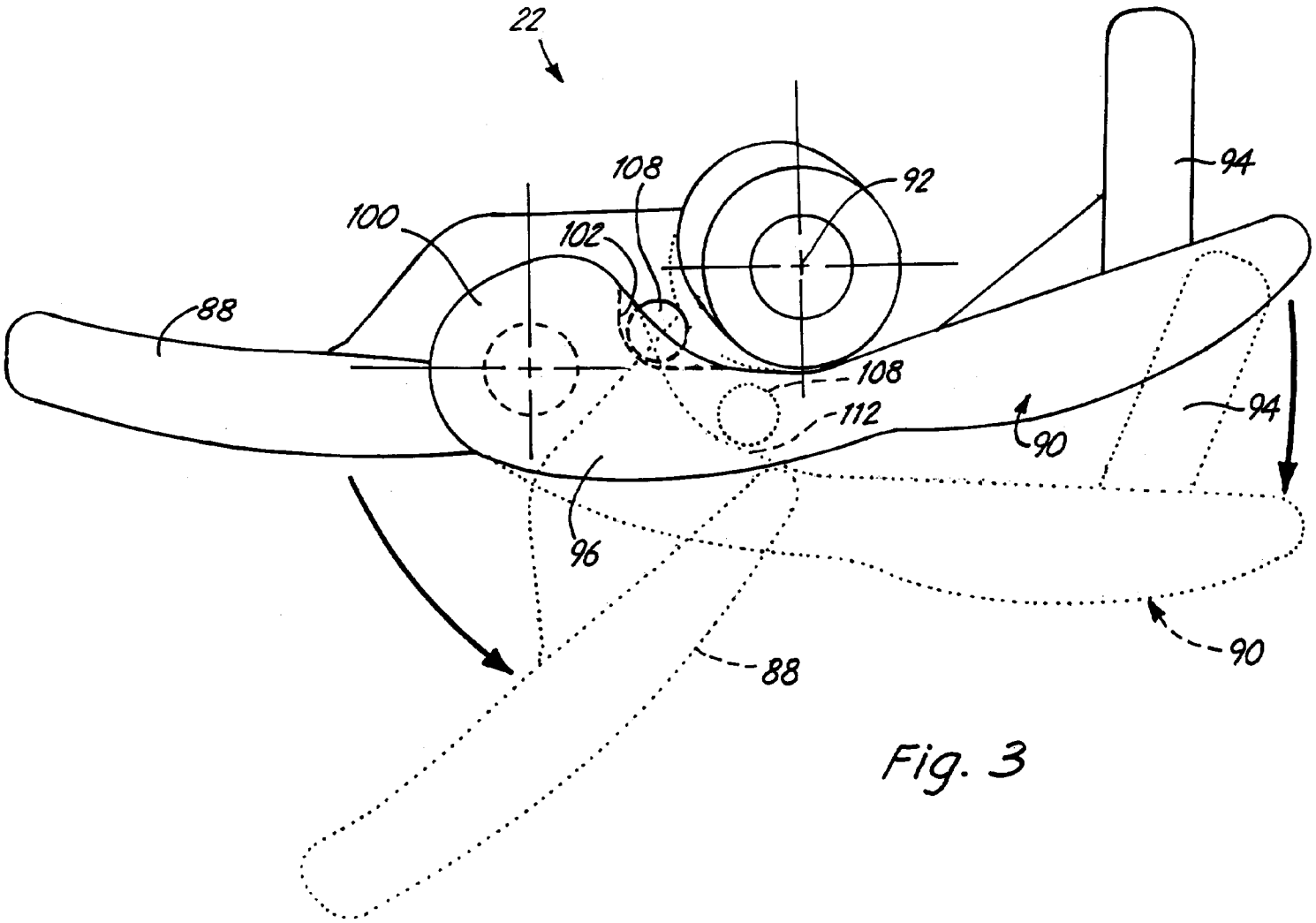
FIG. 3 is a top plan view of the locking mechanism of the present invention.
Figure 4:
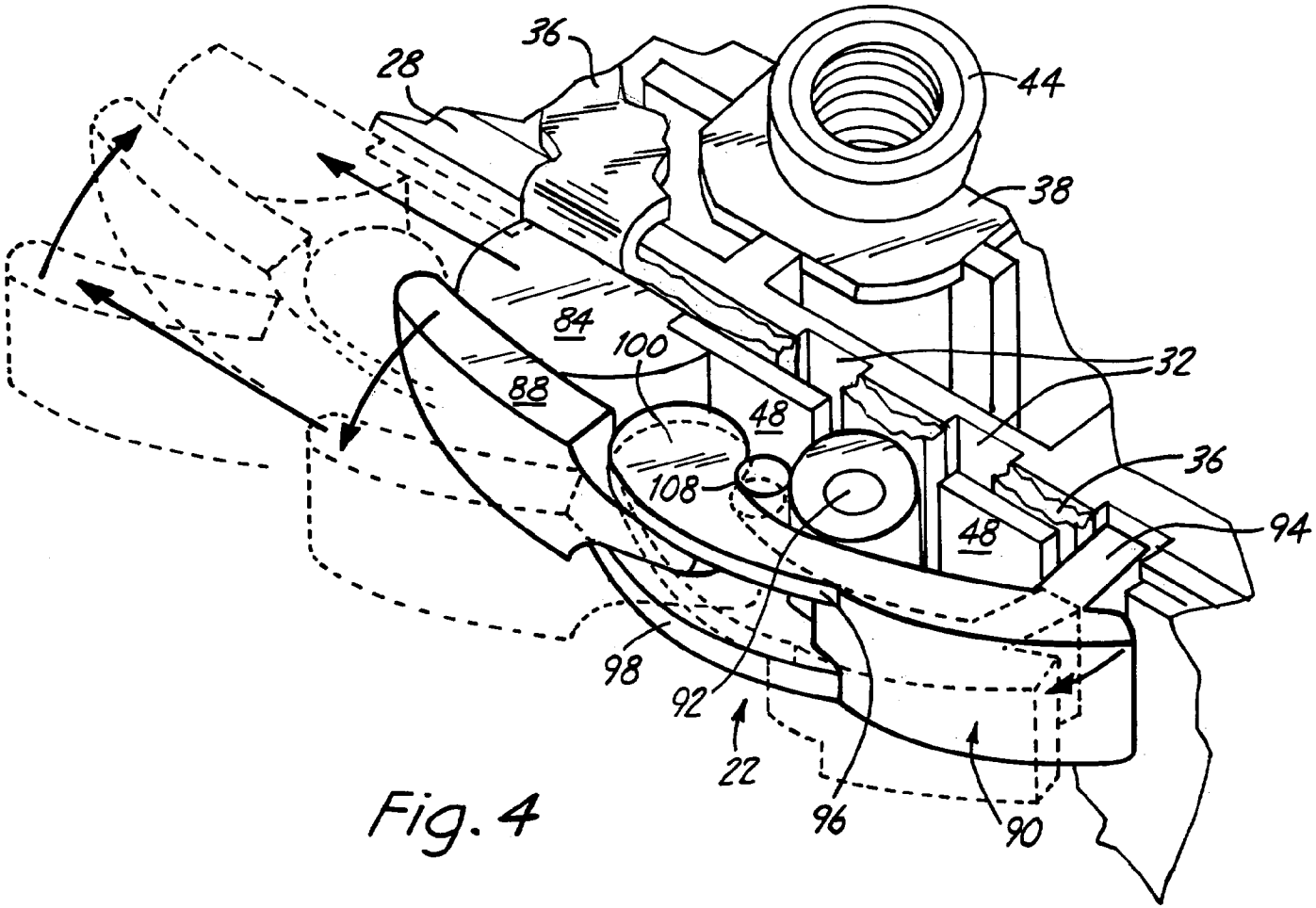
FIG. 4 is a partial perspective view of a locking mechanism engaging and disengaging a forward section the skate of the present invention.
Figure 5:
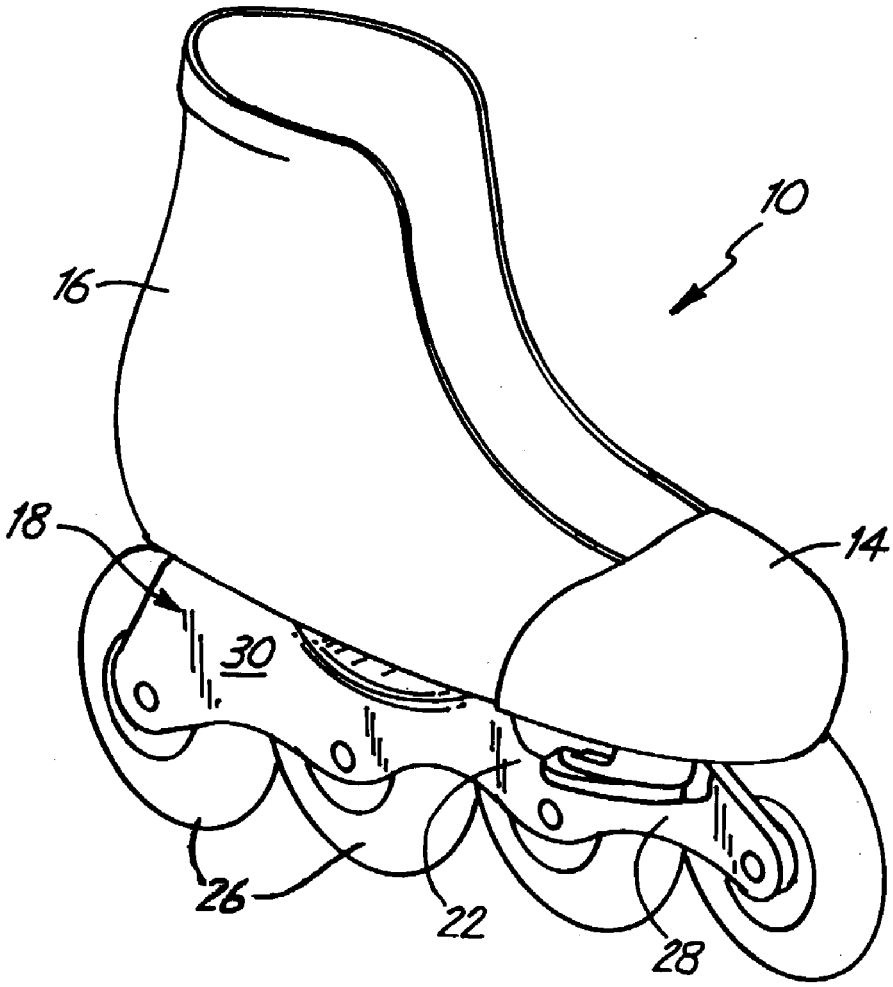
FIG. 5 is a perspective view of a second embodiment of the present invention.

In a first embodiment of the present invention and as illustrated in FIGS. 1–4, the chassis 18 retains an ice engaging blade 24 as is commonly known in the art of ice skates. In a second embodiment of the present invention and as illustrated in FIG. 5, the chassis 18 retains a plurality of freewheeling wheels 26 as is commonly known in the art of inline skates. The wheels 26 are rotatably secured to the chassis 18 by suitable fasteners that are well known in the art. A suitable liner (not shown) is provided to fit within the boot and accept a foot of the a user. The liner has an elastic section proximate the toe box so that the liner can accommodate different foot sizes. In either embodiment, the frame 18 further comprises a forward stanchion 28 and a rearward stanchion 30. For descriptive purposes, the term forward corresponds to the area of the skate 10 for receiving and supporting a ball and toe area of a foot, while the term rearward corresponds to the area of the skate 10 for receiving and supporting a heel area of the foot. Preferably, the heel portion 16 and the rearward stanchion 30 are integrally formed. However, the heel portion 16 may be secured to the rearward stanchion 30 by a variety of means including, but not limited to, riveting, bolting, gluing or stapling.

Referring now to FIG. 1, the forward stanchion 28 is preferably formed to include a plurality of spaced-apart slots 32 positioned on a side surface 34. Each slot 32 is spaced-apart a selected distance and works in conjunction with the locking mechanism 22 to lock the toe box 14 to the front stanchion 28 at the selected position. The selected position corresponds to the overall length of the boot 12, thus the position of each spaced-apart slot 32 corresponds to a selected length of the boot 12. The forward stanchion 28 further includes a portion for receiving a locking plate 36 and locking nut 38. The locking nut 38 seats within the forward stanchion 28 and is secured into position by the locking plate 36 which is fastened to the forward stanchion 28 with screws 40. The locking plate 36 includes a central aperture 42 for receiving a spacer 44 and screw locking bolt 46. The locking screw bolt 46 threadably engages the locking nut 38 and secures the toe box 14 to the forward stanchion 28. The locking plate 36 further includes downwardly extending flange members 48 and a side wall 50. The flange members 48 reinforce the spaced-apart slots 32 and are positioned between the spaced-apart slots 32 proximate the side surface 34 of the forward stanchion 28. The side wall 50 is positioned proximate to an opposing side surface 52 of the forward stanchion 28. Alternatively, the spaced-apart slots 32 disposed within the forward stanchion 28 may be replaced with an open cavity, with the spaced-apart flanges 48 defining slots for receiving the locking mechanism 22. In addition to the flanges 48 working in conjunction with the locking mechanism 22, the flanges 48 and the side wall 50 of the locking member 36 work in conjunction with a slotted sliding member 56 attached to the toe box 14 to slidably secure the toe box 14 to the forward stanchion 28.

Figure 2:
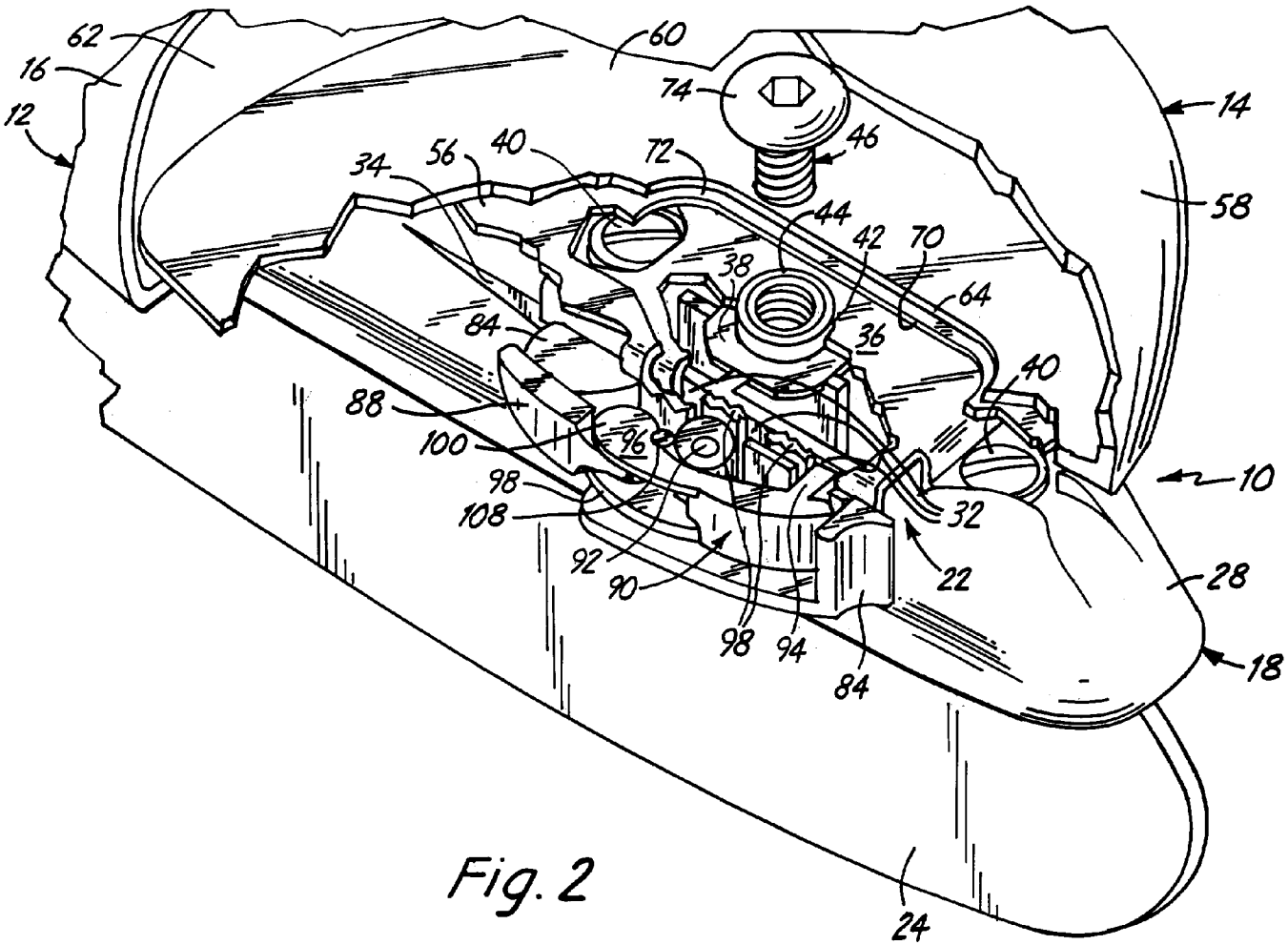
FIG. 2 is a partial perspective view of a forward area of the present invention.

The toe box 14 slidably secures to the forward stanchion 28 and engages the heel portion 16. The toe 14 box includes a forward toe cap portion 58 integrally formed with a toe sole portion 60. As illustrated in FIG. 2, the toe sole portion 60 overlies a top forward surface 62 of the heel portion 16 and includes an elongated slot 64 positioned under the forward toe cap portion 58 along a longitudinal axis of the skate 10. The sliding plate 56 for accepting the forward section 28 of the chassis 18 attaches to an underside surface 66 of the toe box 14 by way of rivets 68. The sliding plate 56 is positioned such that an elongated slot 70 disposed within the sliding plate 56 cooperably aligns with the elongated slot 64 of the toe box 14. The second elongated slot 70 of the sliding plate 56 has a smaller width than a width of the elongated slot 64 positioned within the sole portion 60, resulting in the second elongated slot 70 having an exposed upper surface 72. The toe box 14 slidably secures to the forward stanchion 28 by the sliding plate 56 engaging the locking plate 56 with the locking screw 46 inserting through the first elongated slot 64, the second elongated slot 70, the spacer 44 and threadably engaging the locking nut 38. The screw 46 includes a head 74 having a diameter less than the width of the first elongated slot 64 but greater than the second elongated slot 70, thus the head 74 of the screw 46 engages the exposed upper surface 72 of the second elongated slot 70 to secure the toe box 14 to the forward stanchion 28 while permitting movement of the toe box 14 along the longitudinal axis of the skate 10. Detents 76 positioned on the locking plate 36 mateably engage indentations 78 positioned on the sliding plate 56 at several positions. The sliding plate 56 further includes first and second downwardly extending guide members, 80 and 82 respectively, positioned on opposing sides. The first guide member 80 engages the flanges 48 of the locking plate 36, while the second guide member 82 engages the side wall 50 of the locking plate 36. Each guide member 80 and 82 permits movement of the toe box 14 along the longitudinal axis of the skate 10, while prohibiting transversal movement.

Alternatively, the toe box 14 may include a forward closure strap portion (not shown) that extends upwardly from the sole portion. A conventional buckle is secured to the closure strap to secure the strap portion to the foot of the wearer. The closure strap portion includes left and right strap members each extending upwardly from the sole portion. The buckle is attached to the strap members. The strap members are positioned slightly forward of the instep of the boot 12 and are spaced rearwardly of the toe cap 58.

The toe box 14 is locked into a selected position by the locking mechanism 22. As illustrated in FIGS. 1 and 2, the locking mechanism 22 includes a bracket 84 attached to the underside surface 66 of the toe box 14 by rivets 86. The bracket 84 supports a lever 88 and a locking member 90. Both the lever 88 and the locking member 90 are pivotally attached to the bracket 84 and the toe box 74. A pin 92 inserts through the bracket 84, lever 88 and toe box 14 to pivotally attach the lever 88. The locking member 90 includes a clasp 94 having first and second spaced-apart arms, 96 and 98 respectively, extending therefrom. Terminal ends of each arm 96 and 98 include a rounded portion 100 having a camming surface 102. Terminal ends of each arm 96 and 98 further include a cylindrical member 104 disposed on the rounded portion 100. The cylindrical member 104 of the first arm 96 inserts within an aperture (not shown) disposed within the toe box 14, while the cylindrical member 104 of the second arm 98 inserts within an aperture 106 disposed within the bracket 84, thus pivotally attaching the locking member 90 to the bracket 84 and the toe box 14. The lever 88 slidably disposes between each arm 96 and 98.

As illustrated in FIG. 3, the lever 88 is positionable between a first locked position and a second unlocked position (illustrated by dashed lines). Correspondingly, the locking member 90 is positionable between a first engaged position and a second disengaged position (illustrated by dashed lines). Positioning the lever 88 towards the locked position causes posts 108 disposed upon the lever 88 to engage the adjacent cammed surface 102 of the rounded portion 100 of the respective arm 96 and 98, urging the clasp 94 toward the engaged position wherein the clasp 94 inserts within and engages the selected slot 32. Upon the clasp 94 engaging the selected slot 32, the toe box 14 is locked into position and travel upon the forward stanchion 28 is not permitted. The lever 88 tends to remain in the first locked position due to the frictional engagement of each post 108 with the respective adjacent cammed surface 102. Positioning the lever 88 toward the unlocked position and overcoming the frictional engagement of each post 108 with the respective cammed surface 102 causes each post 108 to disengage from the respective cammed surface 102 and engage an interior surface 112 of the adjacent arm 96 and 98. Further positioning of the lever 88 toward the second unlocked position urges the clasp 94 away from the selected slot 32 to disengage the clasp 94 therefrom. Upon disengagement, the toe box 14 is permitted to travel upon the forward stanchion 28 to increase or decrease the length of the boot 12, as illustrated in FIG. 4.

The length and width of the boot 12 of the present invention is modified by moving the toe box 14 in relation to the heel portion 16, as is fully described in commonly assigned U.S. Pat. No. 6,217,039 and U.S. application Ser. No. 10/004,163, which are incorporated herein by reference. It will be appreciated that the toe sole portion 60 and a heel sole 114 portion cooperate to form a single sole of the boot 12.

To determine the selected size for the boot 12, the locking mechanism 22 is disengaged, allowing the toe box 14 to travel upon the forward stanchion 28. A wearer inserts the proper foot into the boot 12, and the toe box 14 is positioned to accommodate the size of the foot. To decrease the size of the boot 12 or to make the boot smaller, the toe box 14 is moved rearwardly towards the heel portion 16 until the boot properly conforms to the foot of the wearer. Rearward travel of the toe box 14 is limited by the length of the first and second elongated slots 64 and 70 engaging the locking screw 46. In reverse, to increase the length of the boot 12, the toe box 14 is moved forwardly. Forward travel of the toe box 14 is limited by the length of the elongated slots 64 and 70 which the locking screw 46 engages at the most forward extent. Upon positioning the toe box 14 to achieve the selected length of the boot 12, the locking lever 88 is engaged by positioning the mechanism 22 toward the locking position, which urges the clasp 94 into engagement with the most proximate spaced-apart slot 32, and the toe box 14 is locked into position. As the foot of the wearer grows, or for use by a different wearer, the toe box 14 may be unlocked, repositioned to fit the new size of the foot and locked into the new position.

Although the present invention has been described with reference to preferred embodiments, workers skilled in the art will recognize that changes may be made in form and detail without departing from the spirit and scope of the invention.

What is claimed is:

1. A skate comprising:

a chassis having a ground engaging mechanism attached thereto;

a variable length boot supported by the chassis, the boot including a heel portion fixedly attached to the chassis and a toe box slidably secured to the chassis, wherein positioning the toe box along a longitudinal axis of the skate relative to the heel portion increases or decreases the length of the boot; and a latching mechanism to lock the toe box to the chassis at a selected position, the selected position defining the length of the boot, wherein the latching mechanism comprises:

a lever pivotally connected to the toe box, the lever positionable between a locked position and an unlocked position;

a bracket attached to the toe box and supporting the lever;

a clasp connected to the lever to lock the toe box at the selected position, the clasp pivotally connected to the toe box and positionable between an engaged position and a disengaged position; and first and second arms extending from the clasp, each arm including a cylindrical member, wherein the cylindrical member of the first arm pivotally engages the toe box and the cylindrical member of the second arm pivotally engages the bracket.

2. The skate of claim 1 wherein the lever and the clasp are pivotally attached to the bracket.

3. The skate of claim 1 wherein the cylindrical member of each arm includes a cammed surface; and first and second posts disposed upon the lever, wherein the first post is engageable with the cammed surface of the first arm and the second post is engageable with the cammed surface of the second arm, wherein each post urges the clasp towards the engaged position upon positioning the lever towards the locked position.

4. The skate of claim 1, and further comprising a plurality of spaced-apart slots for receiving the clasp, each slot selectively positioned to define the length of the boot when the latching mechanism locks the toe box to the chassis.

5. The skate of claim 4, wherein the plurality of slots are disposed within the chassis.

6. The skate of claim 4, and further comprising a member attached to the chassis, the member containing the plurality of spaced-apart slots.

7. The skate of claim 1, wherein the toe box includes a first elongated slot and further comprising:

a slotted member containing a second elongated slot, the slotted member attached to the toe box such that the first elongated slot and the second elongated slot cooperatively align; and a fastener attached to the chassis for slidably securing the toe box to the chassis, the fastener insertable through the first and second elongated slots, wherein the fastener permits the toe box to only be positionable along a longitudinal axis of the skate.

8. The skate of claim 7, wherein the slotted member attached to the toe box includes parallel sidewalls extending away from the toe box, the sidewalls engaging side surfaces of the chassis to prohibit transversal movement of the box about the longitudinal axis of the skate.

9. The skate of claim 7, wherein the slotted member includes parallel sidewalls extending therefrom, and further comprising a locking plate attached to the chassis, the locking plate including parallel sidewalls extending therefrom, wherein the locking plate and the sidewalls of the locking plate cooperatively engage the slotted member and the sidewalls of the slotted member to prohibit transveral movement of the toe box about the longitudinal axis of the skate.

10. The skate of claim 7, wherein the slotted member includes parallel sidewalls extending therefrom, and further comprising: a locking plate attached to the chassis, the locking plate including parallel sidewalls extending therefrom positioned proximate to side surfaces of the chassis, wherein the locking plate seats within the sidewalls of the slotted member, the slotted member engaging the locking plate, and the sidewalls of the slotted member engaging the adjacent sidewalls of the locking plate.

11. The skate of claim 10 wherein the sidewall of the locking plate proximate the latching mechanism includes a plurality of spaced-apart slots for receiving the clasp of the latching mechanism.

12. The skate of claim 1 wherein the ground engaging mechanism is an ice blade or a plurality of wheels.

13. A skate comprising:

a chassis for holding a ground engaging mechanism attached thereto, the chassis having a forward section and a rearward section;

a boot having a heel portion and a toe box, wherein the heel portion is disposed upon the rearward section of the chassis and the toe box is slidable upon the forward section of the chassis to adjust the length of the boot;

a latching mechanism attached to the toe box for securing the toe box to the forward section of the chassis in a selected position; and a plurality of spaced-apart slots disposed upon the forward section of the chassis for receiving the latching mechanism to secure the toe box in the selected position through the attachment of the latching mechanism to the toe box; and wherein the latching member comprises a clasp and first and second spaced-apart arms extending from the clasp, wherein the lever is disposed between and engages the first and second arms and wherein at least one arm is pivotally connected to the first and second arms, and wherein at least one arm is pivotally connected to the bracket or the toe box;

wherein the latching comprises a latching member to engage a selected slot; and a lever connected to the latching member, the lever providing a mechanism to engage and disengage the latching member; and wherein the latching mechanism further comprises a bracket attached to the toe box, wherein the lever and the latching member pivotally attaches to the bracket.

14. A skate comprising:

a chassis for holding a pound engaging mechanism attached thereto, the chassis having a forward section and a rearward section;

a boot having a heel portion and a toe box, wherein the heel portion is disposed upon the rearward section of the chassis and the toe box is slidable upon the forward section of the chassis to adjust the length of the boot;

a latching mechanism attached to the toe box for securing the toe box to the forward section of the chassis in a selected position; and a plurality of spaced-apart slots disposed upon the forward section of the chassis for engaging the latching mechanism to secure the toe box in the selected position through the attachment of the latching mechanism to the toe box; and wherein the latching mechanism comprises a latching member to engage a selected slot; and a lever connected to the latching member, the lever providing a mechanism to engage and disengage the latching member; and wherein the latching mechanism further comprises a bracket attached to the toe box, wherein the lever and the latching member pivotally attaches to the bracket;

wherein the latching member comprises a clasp and first and second spaced-apart arms extending from the clasp, wherein the lever is disposed between and engages the first and second arms, and wherein at least one arm is pivotally connected to the bracket or the toe box.

15. The skate of claim 13 and further comprising:

a first plate attached to the toe box, the first plate including an elongated slot positioned along a longitudinal axis of the skate;

a second plate attached to the forward section of the chassis, the second plate engageable with the first plate; and a fastener connected to the second plate and insertable through the elongated slot, the fastener securing the toe box to the forward section of the chassis, wherein the toe box is positionable about the forward section of the chassis.

16. The skate of claim 15, wherein the first plate includes first and second downwardly extending sidewalls, the forward section of the chassis extending between the first and second sidewalls.

17. The skate of claim 13 wherein the ground engaging mechanism is an ice blade or a plurality of wheels.

18. A skate comprising:

a frame for holding a ground engaging mechanism attached thereto, the frame having a rearward section and a forward section;

a variable length boot, the boot having a heel portion attached to the rearward section and a toe box slidably secured to the forward section;

a clasping mechanism connected to the toe box;

a plurality of spaced-apart slots disposed upon the forward section of the chassis for receiving the clasping mechanism;

wherein the clasping mechanism comprises a bracket attached to the toe box proximate to the plurality of spaced-apart slots, a clasp pivotally connected to the bracket for engaging a selected slot, and a lever connected to the clasp, the lever providing a mechanism to engage the clasp with the selected slot; and wherein the clasp comprises first and second spaced-apart arms connected to the clasp, wherein at least one arm pivotally secures either to the bracket or to the toe box, wherein the lever is disposed between and engages each arm, and wherein positioning the lever urges the arms to pivot and position the clasp to engage or disengage the selected slot.

19. The skate of claim 18 wherein the first arm and the second arm extending from the clasp each include a cammed surface, and the latching mechanism further comprises first and second posts disposed upon the lever, wherein the first post is engageable with the cammed surface of the first arm and the second post is engageable with the cammed surface of the second arm, wherein each post urges the clasp towards the engaged position upon positioning the lever towards a locked position, position.

20. The skate of claim 18, and further comprising:

an elongated slot disposed within the toe box along a longitudinal axis of the skate; and a fastener disposed within the elongated slot and connected to the forward section of the frame, the fastener slidably securing the toe box to the forward section.

21. The skate of claim 18, wherein the toe box includes an elongated slot and wherein the forward section includes a fastener connected thereto, the fastener slidably securing the toe box to the forward section.

22. The skate of claim 18 wherein the ground engaging mechanism is an ice blade or a plurality of wheels.

23. A skate comprising:

a chassis having a ground engaging mechanism attached thereto;

a variable length boot supported by the chassis, the boot including a heel portion fixedly attached to the chassis and a toe box slidably secured to the chassis, wherein positioning the toe box along a longitudinal axis of the skate relative to the heel portion increases or decreases the length of the boot; and a latching mechanism to lock the toe box to the chassis at a selected position, the selected position defining the length of the boot, wherein the latching mechanism comprises:

a lever pivotally connected to the toe box, the lever positionable between a locked position and an unlocked position;

a clasp connected to the lever to lock the toe box at the selected position, the clasp pivotally connected to the toe box and positionable between an engaged position and a disengaged position; and wherein the latching mechanism further comprises: first and second arms extending from the clasp, each arm including a cammed surface; and first and second posts disposed upon the lever, wherein the first post is engageable with the cammed surface of the first arm and the second post is engageable with the cammed surface of the second arm, wherein each post urges the clasp towards the engage position upon positioning the lever towards the locked position.

24. A skate comprising:

a chassis having a ground engaging mechanism attached thereto;

a variable length boot supported by the chassis, the boot including a heel portion fixedly attached to the chassis and a toe box slidably secured to the chassis, wherein positioning the toe box along a longitudinal axis of the skate relative to the heel portion increases or decreases the length of the boot; and a latching mechanism to lock the toe box to the chassis at a selected position, the selected position defining the length of the boot, wherein the latching mechanism comprises:

a lever pivotally connected to the toe box, the lever positionable between a locked position and an unlocked position;

a clasp connected to the lever to lock the toe box at the selected position, the clasp pivotally connected to the toe box and positionable between an engaged position and a disengaged position; and first and second arms extending from the clasp, each arm including a cylindrical member, wherein the cylindrical member of the first arm pivotally engages the toe box and the cylindrical member of the second arm pivotally engages the bracket;

wherein the toe box includes a first elongated slot and further comprising:

a slotted member containing a second elongated slot, the slotted member attached to the toe box such that the first elongated slot and the second elongated slot cooperatively align;

a fastener attached to the chassis for slidably securing the toe box to the chassis, the fastener insertable through the first and second elongated slots, wherein the fastener permits the toe box to only be positionable along a longitudinal axis of the skate; and wherein the slotted member includes parallel sidewalls extending therefrom, and further comprising a locking plate attached to the chassis, the locking plate including parallel sidewalls extending therefrom, wherein the locking plate and the sidewalls of the locking plate cooperatively engage the slotted member and the sidewalls of the slotted member to prohibit transversal movement of the toe box about the longitudinal axis of the skate.

* * * * *